United States Patent [19]

Prince

[11] Patent Number: 4,985,603

[45] Date of Patent: Jan. 15, 1991

[54] ELECTRIC SWITCH HAVING REDUCED ACTUATOR PLAY

[76] Inventor: Thomas F. Prince, 1175 Brook Rd., Milton, Mass. 02186

[21] Appl. No.: 440,687

[22] Filed: Nov. 24, 1989

[51] Int. Cl.[5] ..... H01H 3/12; H01H 3/48; H01H 13/70

[52] U.S. Cl. ..... 200/341; 200/342; 200/344; 200/345; 200/459; 200/408

[58] Field of Search ..... 200/341, 342, 344, 345, 200/5 A, 5 E, 453, 459, 460, 461, 520, 408, 409

[56] References Cited

U.S. PATENT DOCUMENTS

| | | | |
|---|---|---|---|
| 2,556,981 | 6/1951 | Raney | 200/459 |
| 3,777,090 | 12/1977 | Muller | 200/342 X |
| 4,132,877 | 1/1979 | Daige | 200/341 X |
| 4,707,578 | 11/1987 | Burkhardt | 200/520 |
| 4,742,186 | 5/1988 | Miura | 200/5 E |

*Primary Examiner*—Ernest G. Cusick
*Attorney, Agent, or Firm*—Sylvia L. Boyd

[57] ABSTRACT

An electric switch design compensates for unpredictable but significant variability, within a known range, in case and cover material shrinkage during manufacture. A contact actuator has radially spaced guide bosses and an axial barrel providing a plurality of external axially extending sharp bearing ridges. Case guide structure cooperates with the actuator guide bosses to permit actuator travel generally normal to the case floor. The actuator is dimensioned with respect to the case guide structure to accommodate the unpredictable case material shrinkage variability and thereby to permit actuator play in which the actuator axis is rotatable out of the normal to the case floor. The switch cover provides an actuator collar having an inner, surface coaxial with the normal to the case floor and dimensioned with respect to the actuator barrel such that for all shrinkage values within the known range, the actuator barrel bearing ridges interfere with the collar inner surface for reduction of actuator play with minimal friction between barrel and actuator collar.

7 Claims, 4 Drawing Sheets

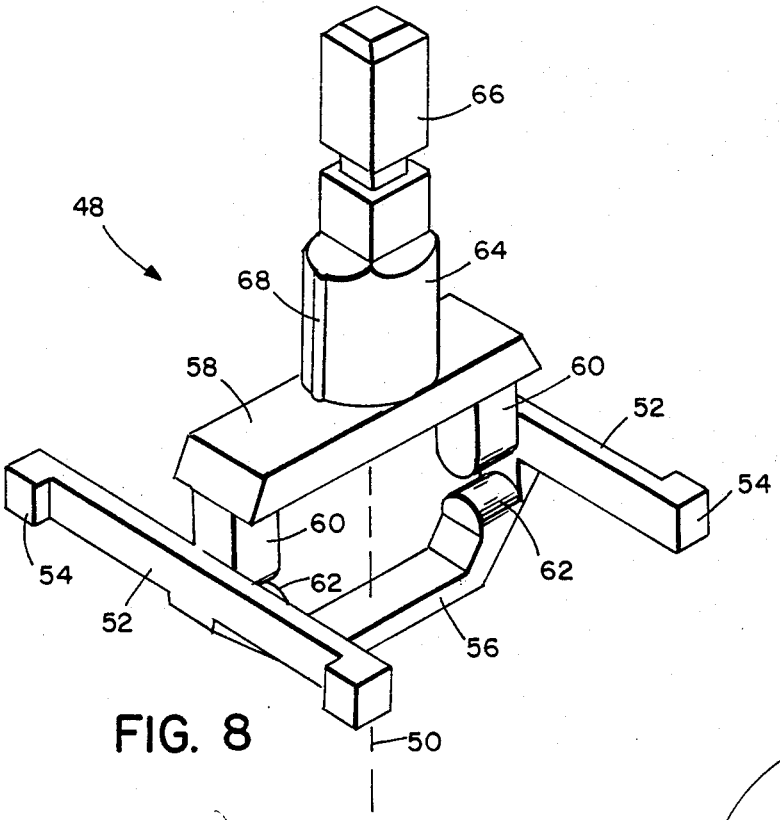
FIG. 8
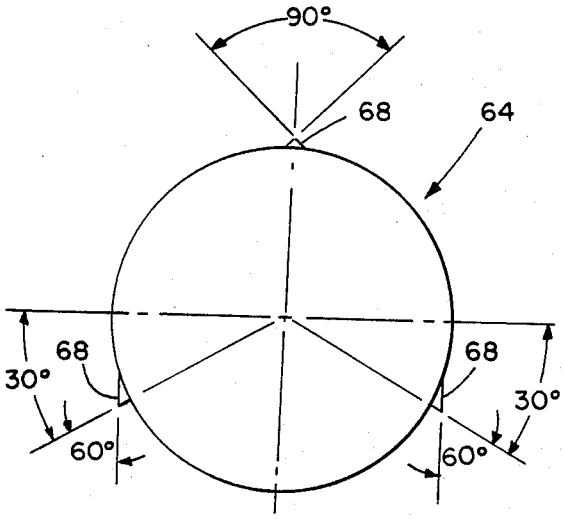
FIG. 9
FIG. 10
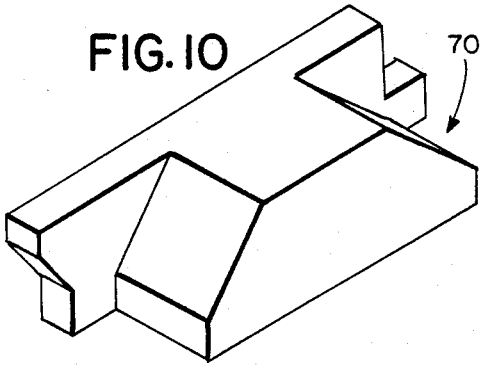
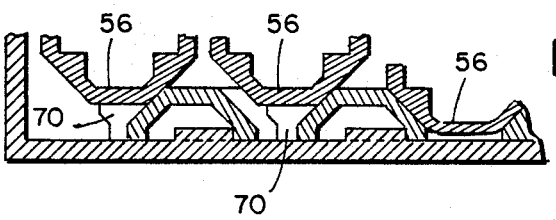
FIG. 11

ELECTRIC SWITCH HAVING REDUCED ACTUATOR PLAY

This invention relates to electric switches. In particular, it relates to the reduction of play of an actuator retained loosely in a switch casing, to provide a tightly positioned actuator or well-aligned row of actuators.

Recently a number of new moldable plastic materials have become available, which are highly desirable for use in making switch casings and covers because they offer particular electrical and mechanical characteristics, and because they have desirable flammability ratings. A particular material of this nature is polybutyleneterephthalate (PBTP), sold by General Electric under the trade name "360 E Valox". However, the design of a switch employing this material has posed problems because PBTP has a relatively high shrinkage during molding, which varies unpredictably, within a known range, from batch to batch of PBTP. The range of shrinkage itself varies with thickness of the material, and the resulting unpredictable variations in dimensions of the various parts of the molded case are significant with respect to acceptable tolerances.

To allow for the resulting variability in casing and cover dimensions, it has been necessary to design for a relatively loose fit between casing and cover and other switch elements, in particular an actuator whose travel is guided by structure molded as part of the casing and cover. As a result, it has been found that an unacceptably large amount of actuator play results, adversely affecting marketability of the switch. For example, pushbuttons affixed to the actuators do not line up acceptably, and the feel of excess play leads customers to reject the switch even though it may perform reliably. Similar problems can arise with the use of other materials which have significant dimensional changes whose magnitude is not precisely known beforehand, either in production or at a later time.

It is therefore an object of the invention to provide a switch whose casing and cover design can accommodate a range of materials shrinkage, but whose actuators nevertheless have minimal play.

At the same time, because relatively low operating force is a desirable feature of such a switch, it is desirable not to increase such force. Therefore, it is an object of the invention to provide such a switch having reduced actuator play without significantly increased actuating force.

BRIEF SUMMARY OF THE INVENTION

According to the invention, an electric switch comprises a case and cover molded of material exhibiting unpredictable shrinkage within a known range, resulting in unpredictable variability in case and cover dimensions which is significant with respect to acceptable design tolerances. At least one contact assembly is supported in the case and comprises first and second contact terminals each having a terminal end extending through the case. The first contact terminal carries a first contact; the second contact terminal has an arm carrying a second contact, the arm being movable between two positions, in one of which the first and second contacts are maintained in electrical connection, in the other of which the first and second contacts are maintained out of electrical connection.

A contact actuator having its axis generally normal to the case floor has guide bosses radially spaced about the actuator axis, means adjacent the guide bosses for moving the second contact terminal movable arm between the two positions, and an axial barrel axially spaced from the guide bosses, and providing a plurality of equally spaced external axially extending sharp bearing ridges.

Case guide structure cooperates with the actuator guide bosses to permit actuator travel generally normal to the case floor. The actuator is dimensioned with respect to the case guide structure to accommodate the unpredictable case material shrinkage variability and thereby to permit actuator play in which the actuator axis is rotatable out of the normal to the case floor. The switch cover provides an actuator collar having an inner surface coaxial with the normal to the case floor and dimensioned with respect to the actuator barrel such that for all shrinkage values within the known range, the actuator barrel bearing ridges interfere with the collar inner surface for reduction of actuator play with minimal friction between barrel and actuator collar.

Other objects, features and advantages will appear from the following detailed description of a preferred embodiment of the invention, together with the drawing, in which:

BRIEF DESCRIPTION OF THE DRAWING

FIGS. 8 and 9 show the contact terminal actuator;

FIG. 10 shows a lockout slide;

FIG. 11 shows a plurality of lockout slides interacting with a plurality of contact terminal actuators;

DETAILED DESCRIPTION

Figure 1:
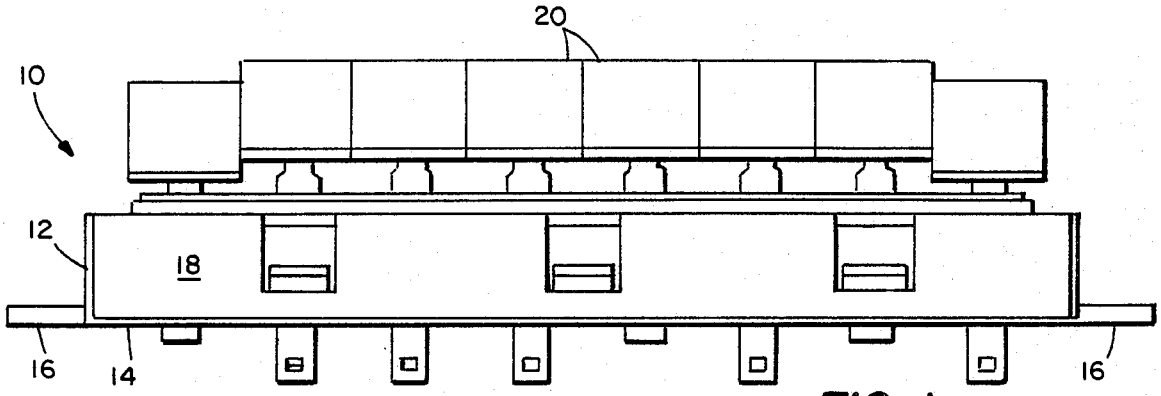
FIG. 1 is an elevation of an assembled switch in which the invention is embodied.

Referring now to the drawing, and in particular to FIG. 1, an assembled switch 10 in which the invention is embodied comprises a case 12 having a case floor 14, and providing flanges 16 by which the assembled switch may be secured to other structure. A cover 18 is snapped over case 12. Disposed within the assembled case and cover are a plurality of contact assemblies, each comprising a pair of contact terminals and an actuator, as will be described. In the particular embodiment described herein there are eight contact assemblies arranged in line. A free end of each actuator extends outside cover 18 and to it is affixed an actuator pushbutton 20.

Figure 2:
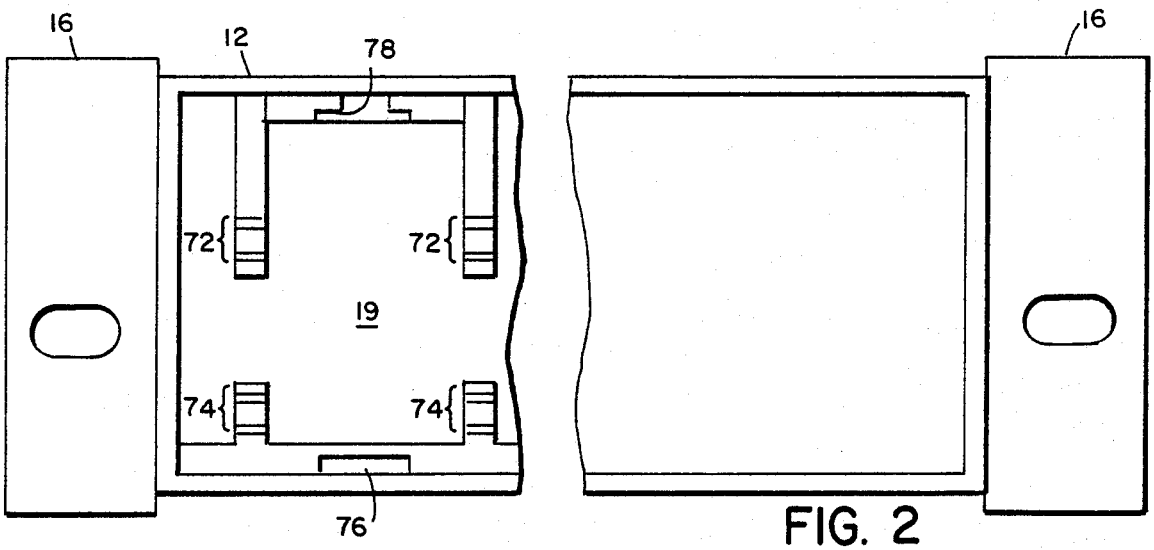
FIG. 2 is a partial plan view of the switch case seen from above.
Figure 3:
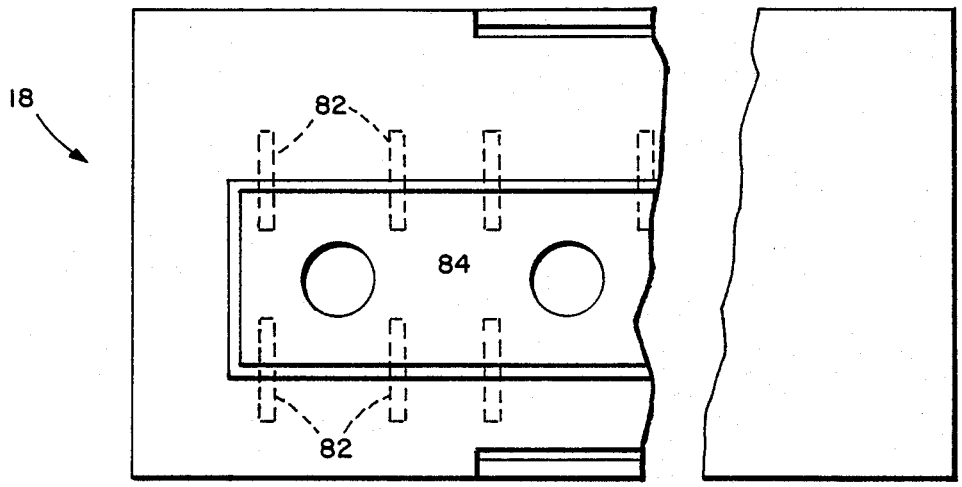
FIG. 3 is a partial plan view of the switch cover seen from above.

In the preferred embodiment, case and cover are molded of polybutyleneterephthalate (PBTP), sold by General Electric under the trade name "360 E Valox". This material has flammability rating and electrical and mechanical characteristics which make it extremely desirable for use in a switch of this type. However, the inherent shrinkage of the material in the molding process varies with part thickness and from batch to batch of material. For a part of thickness between 25 and 50 thousandths of an inch, shrinkage ranges from about 0.006 to about 0.010 inch/inch; for a part of thickness between 50 to 100 thousandths of an inch, shrinkage ranges from about 0.010 to about 0.015 inch/inch; for a part of thickness from 100 to 180 thousandths of an inch, shrinkage ranges from about 0.012 to about 0.018 inch/inch. Within the ranges, variability cannot be predicted. Over the dimensions of a multicavity case and cover as shown in FIGS. 1–3, which is about 8 inches long, such unpredictable variability of shrinkage becomes significant as compared with acceptable tolerances.

Figure 4:
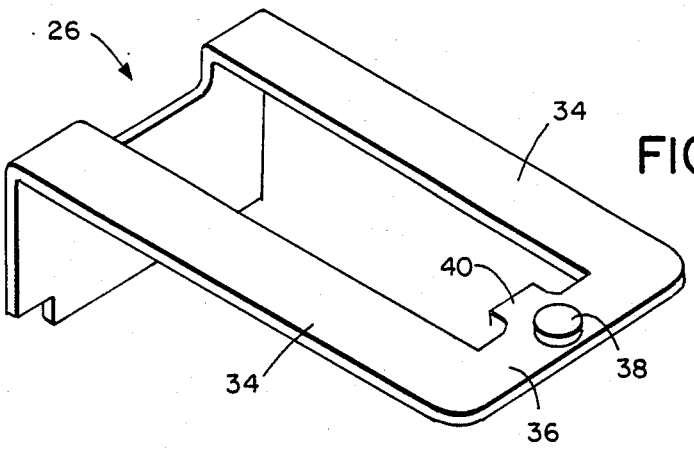
FIGS. 4, 5 and 6 show a first contact terminal of the switch.
Figure 6:
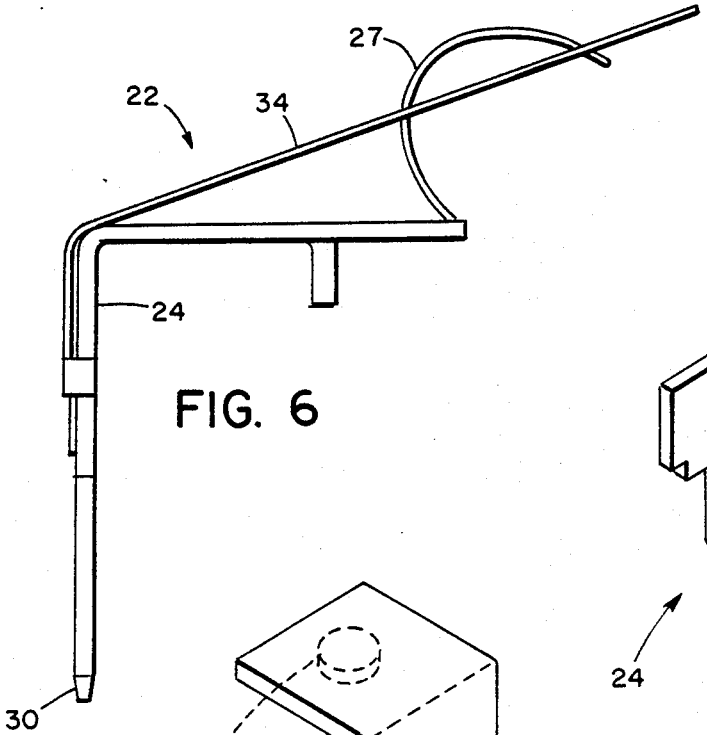
Figure 5:
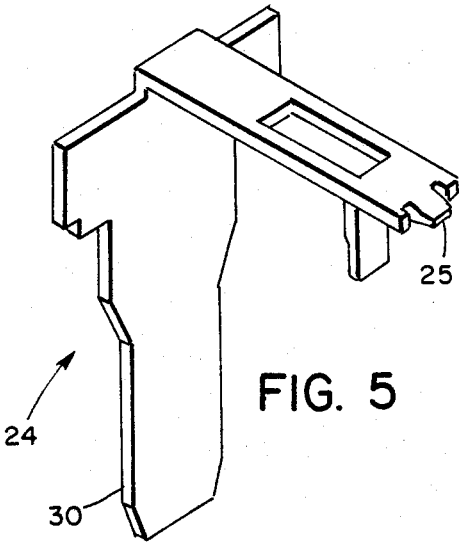
Figure 7:
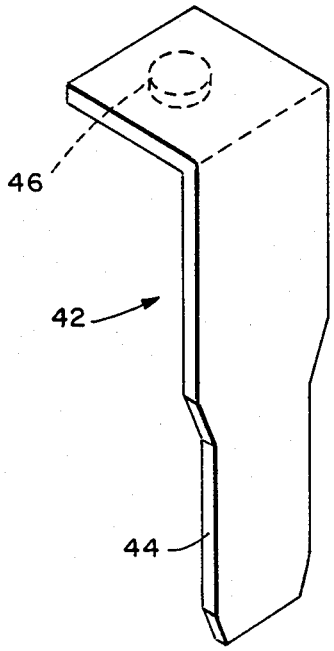
FIG. 7 shows a second contact terminal of the switch.

Referring now to FIGS. 4–6, a first contact terminal 22 comprises a contact anchor 24 (FIG. 5), a contact spring 26 (FIG. 4) and a C-spring 27. Contact anchor 24 is made of brass and provides a terminal end 30 suitable for connection of switch 10 to other apparatus. Contact anchor 24 provides a spring retainer 25. Contact spring 26 is made of a high performance copper alloy, chosen to be suitable for the current rating of the switch; spring 26 provides a contact arm 34 bridged distally at 36 and carrying a contact 38, desirably made of fine silver, or alternatively of silver alloy such as silver cadmium oxide. Bridge 36 provides a spring retainer 40. C-spring 27 is made of beryllium copper. Contact anchor 24 and contact spring 26 are assembled together by welding or staking, as shown in FIG. 6, with C-spring 27 captured between spring retainers 25 and 40. The second contact terminal 42 is shown in FIG. 7. Terminal 42, which is desirably made of brass, provides a terminal end 44 and a contact 46 of fine silver or silver alloy, positioned to overlie contact 38 of first contact terminal 22 when the terminals are positioned in the switch case.

The design of contact terminals such as 22 and 42 is well understood in the art, forms no part of the present invention, and will not be further described.

Referring to FIG. 8, actuator 48 is desirably molded of an injection molding resin such as nylon combined with a natural lubricant such as molybdenum disulphide. This material is sold by Polymer Corp. under the trade name Nylatron GS; it provides suitable properties of tensile and compressive strength, low surface friction, and dimensional stability.

Actuator 48 has an axis 50 which in the assembled condition of switch 10 is generally normal to case floor 14. Two side rods 52 each carry two guide bosses 54; side rods 52 are joined by lower bridge 56 and by upper bridge 58. Bridges 56 and 58 provide terminal spring capture structure 60 and 62. Extending axially from upper bridge 58, away from side arms 52, is a cylindrical barrel 64, beyond which extends a squared actuator free end 66 to which an actuator pushbutton 20 may be affixed external to switch cover 18. Referring also to FIG. 9, barrel 64 provides three equally spaced external sharp axially extended bearing ridges 68.

The switch of the embodiment described and illustrated herein is a slide actuated pushbutton switch, having a plurality of lock-out slides 70 (FIG. 10), which are actuated by actuator lower bridges 56 as illustrated in FIG. 11, in response to pressure on pushbuttons 20, such that when one pushbutton is depressed the others are lifted. Operation of a pushbutton slide switch in this or a similar manner is well understood in the art, forms no part of the present invention, and will not be further described.

Referring again to FIG. 2, case floor 14 provides a first aperture 78 through which terminal end 30 of first contact terminal 22 extends when terminal 22 is fixed within case 12, and an opposed second aperture 76 through which terminal end 44 of second contact terminal 42 extends when terminal 42 is fixed within case 12. Paired guide structures 72, 74 are disposed to either side of the area between apertures 78 and 76. Other details of the interior of case 12 have been omitted as not germane to the invention.

Figure 12:
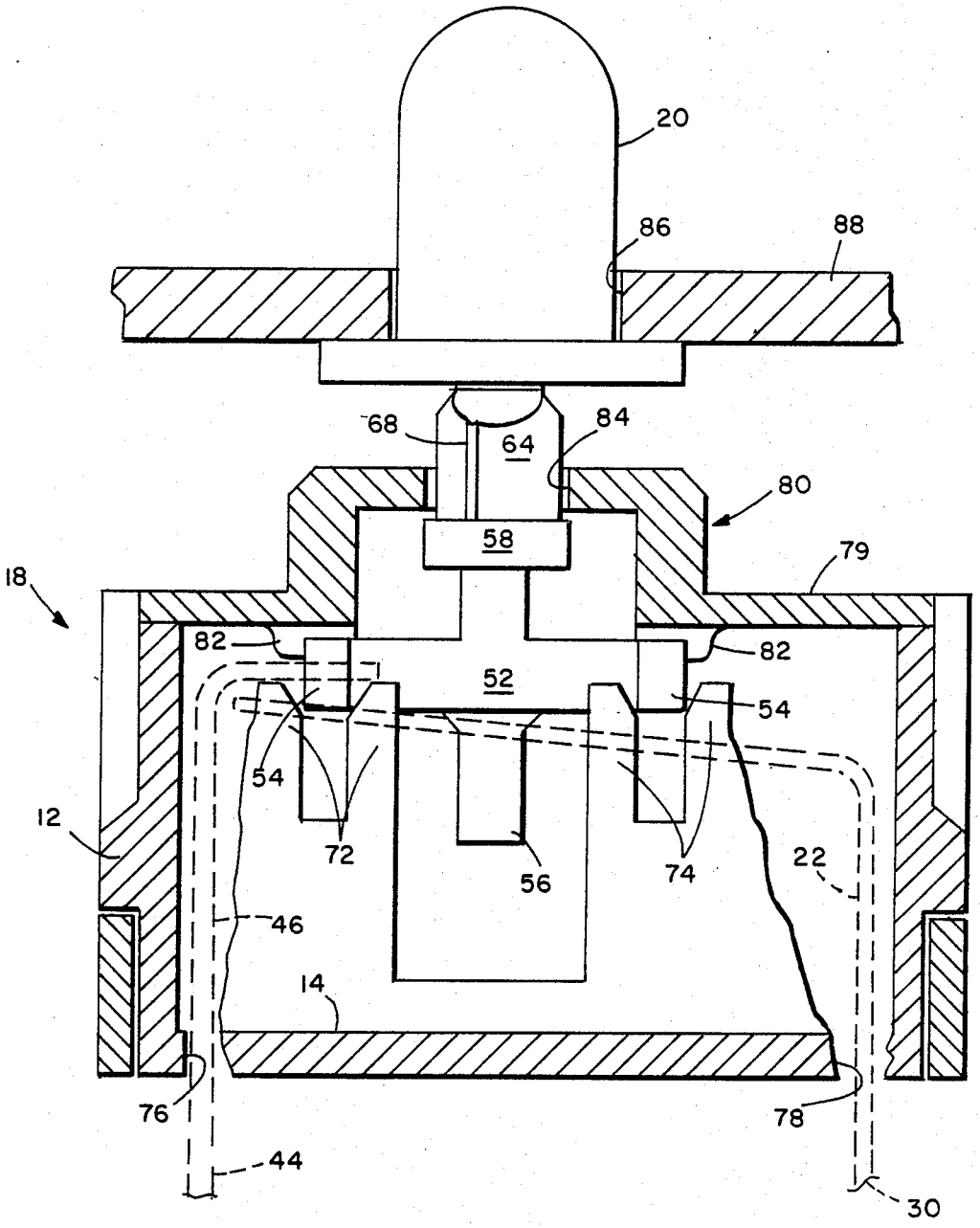
FIG. 12 is a section, partially broken away, through the case and cover of an assembled switch embodying the invention, with the contact terminal actuator shown in elevation and the first and second contact terminals in phantom.

Referring now to FIG. 12, the case 12 and cover 18 are shown in assembled condition, as in FIG. 1. Pushbuttons 20 extend through a slot 86 in a panel 88 of the apparatus to be controlled, and are retained on actuator ends 66 by overlying panel 88. It is an important aspect of marketability of the switch that the pushbuttons 20 be in line and present a uniform appearance.

First and second contact terminals 42 and 22 are indicated in phantom. Contact arm 34 of first terminal 22 passes between contact spring capture structures 60, 62 of actuator 48 and is thereby carried between two stable contact conditions responsive to axial travel of actuator 48. Actuator guide bosses 54 engage with guide structure 72, 74 during such axial travel. To accommodate the unpredictable shrinkage of the case material during the molding process, which as has been stated may range from 0.006 to 0.018 inch/inch depending on thickness, it is necessary to design guide structure 72, 74 to provide a relatively loose fit to guide bosses 54. As a result, the actuator axis is rotatable out of the normal to the case floor through an angle of as much as 15 degrees.

Referring now to FIG. 3 together with FIG. 12, cover 18 provides a top portion 79; a box portion 80 is raised axially above top portion 79. Depending from the inside surface of box portion 80 where it joins top portion 79 are four ribs 82 (indicated in phantom in FIG. 3) which help to position actuator 48 at the upper end of its travel. Box portion 80 provides actuator collar 84 centered over a corresponding contact assembly fixed in case 12. The inner surface of collar 84 is coaxial with the normal to case floor 14, and is dimensioned with respect to actuator barrel 64 such that the sharp edges of bearing ridges 68 interfere with the collar inner surface to provide a close sliding fit. The parts are designed to accommodate shrinkage such that for any shrinkage within the known range, interference is provided but friction between ridges 68 and collar inner surface is maintained low enough not to significantly increase the force required to move actuator 48. Such interference tends to center barrel 64 within collar 84 and thereby to axially align actuator 48 with the normal to case floor 14, to substantially reduce actuator play. Because the interference is between extended sharp edges and the collar inner surface, friction between actuator barrel and collar is minimized and the force required to actuate the switch assembly is not significantly increased. Three ridges are the minimum required positively to position actuator barrel 64 within collar 84.

The alignment of actuator 48 by collar 84 and barrel 64 is also advantageous in that barrel 64 is axially spaced away from the location of the play, namely the loose engagement of guide bosses 54 within guide structure 74. Control of such play is more effectively accomplished from an axially spaced position than from a position closer to the place where the play occurs.

What is claimed is:

1. An electric switch comprising a case and cover molded of material exhibiting unpredictable shrinkage within a known range, resulting in unpredictable variability in case and cover dimensions which is significant with respect to acceptable design tolerances, said case providing a floor, at least one contact assembly supported in said case and comprising a first contact terminal having a terminal end extending through said case, said first contact terminal carrying a first contact, a second contact terminal having a terminal end extending through said case, and having an arm carrying a second contact, said second contact terminal arm being movable between two positions, in one of which said first and second contacts are maintained in electrical connection, in the other of which said first and second contacts are maintained out of electrical connection, a contact actuator having an axis generally normal to said case floor, having guide bosses spaced away from said actuator axis, means adjacent said guide bosses for moving said second contact terminal movable arm between said two positions, and an axial barrel axially spaced from said guide bosses, and providing a plurality of equally spaced external axially extending sharp bearing ridges, said case providing case guide structure cooperating with said actuator guide bosses to permit actuator travel generally normal to said case floor, said actuator being dimensioned with respect to said case guide structure to accommodate said unpredictable case material shrinkage variability and thereby permitting actuator play in which said actuator axis is rotatable out of a normal to the case floor, said switch cover providing an actuator collar having an inner surface coaxial with a normal to said case floor and dimensioned with respect to said actuator barrel such that for all shrinkage values within said known range, said actuator barrel bearing ridges interfere with said collar inner surface for reduction of said actuator play with minimal friction between said barrel and said plurality of actuator collar.

2. The switch of claim 1, said case and cover being made of polybutyleneterephthalate.

3. An electric switch comprising a case and cover molded of material exhibiting batchwise unpredictable shrinkage within a known range in the molding process, resulting in unpredictable variability in case and cover dimensions which is significant with respect to acceptable manufacturing tolerances, said case providing a floor, at least one contact assembly supported in said case and comprising a first contact terminal having a terminal end extending through said case floor, said first contact terminal carrying a first contact, a second contact terminal having a terminal end extending through said case floor, and having an spring arm carrying a second contact, said second contact terminal arm being movable between two stable positions, in one of which said first and second contacts are maintained in electrical connection, in the other of which said first and second contacts are maintained out of electrical connection, a contact actuator having an axis generally normal to said case floor, having guide bosses spaced away from said actuator axis, spring arm capture means adjacent said guide bosses for capturing said second contact terminal movable spring arm and for moving said spring arm between said two positions, and an axial cylindrical barrel axially spaced from said guide bosses, and providing a plurality of equally spaced external axially extending sharp bearing ridges, said case providing case guide structure cooperating with said actuator guide bosses to permit actuator travel generally normal to said case floor, said actuator being dimensioned with respect to said case guide structure to accommodate said batchwise unpredictable case material shrinkage and thereby permitting actuator play in which said actuator axis is rotatable out of a normal to the case floor, said switch cover providing an actuator collar having a cylindrical inner surface coaxial with a normal to said case floor, having an axial length less than the axial extent of said barrel ridges, and dimensioned with respect to said plurality of actuator barrel such that for all shrinkage values within said known range, said actuator barrel bearing ridges interfere with said collar inner surface for reduction of said actuator play with minimal friction between said barrel and said actuator collar.

4. The switch of claim 3, said case and cover being made of polybutyleneterephthalate.

5. The switch of claim 3, wherein said material shrinkage ranges from about 0.8 percent to about 1.5 percent.

6. The switch of claim 3, wherein said material shrinkage ranges from about 0.6 percent to about 1.8 percent.

7. The switch of claim 3, having a plurality of said contact assemblies disposed with their said actuator barrels aligned, each said actuator barrel extending outwardly through a corresponding said switch cover collar and having a free end external to said switch cover, said actuator free ends being aligned, said switch having a similar plurality of actuator pushbuttons, each carried on a said actuator barrel free end.

* * * * *